US007777633B2

(12) United States Patent
Knox et al.

(10) Patent No.: US 7,777,633 B2
(45) Date of Patent: Aug. 17, 2010

(54) METHOD AND SYSTEM FOR DETERMINING PARTICLE TRANSMITTANCE OF A FILTER IN PARTICLE DETECTION SYSTEM

(75) Inventors: Ron Knox, Mount Eliza (AU); Karl Boettger, Glen Waverley (AU)

(73) Assignee: Vision Fire & Security Pty Ltd, Mount Waverley (AU)

( * ) Notice: Subject to any disclaimer, the term of this patent is extended or adjusted under 35 U.S.C. 154(b) by 360 days.

(21) Appl. No.: 10/564,732

(22) PCT Filed: Jul. 16, 2004

(86) PCT No.: PCT/AU2004/000954

§ 371 (c)(1),
(2), (4) Date: Feb. 26, 2007

(87) PCT Pub. No.: WO2005/008610

PCT Pub. Date: Jan. 27, 2005

(65) Prior Publication Data

US 2007/0176783 A1 Aug. 2, 2007

(30) Foreign Application Priority Data

Jul. 18, 2003 (AU) ..... 2003903703

(51) Int. Cl.
*G08B 21/00* (2006.01)

(52) U.S. Cl. ..... 340/607; 340/609; 702/23; 250/222.2

(58) Field of Classification Search ..... 340/628, 340/630, 607–609; 702/22–26; 255/222.2, 255/574; 356/337–338; 250/222.2, 574
See application file for complete search history.

(56) References Cited

U.S. PATENT DOCUMENTS 4,168,438 A 9/1979 Morisue (Continued)

FOREIGN PATENT DOCUMENTS

EP 0290413 A3 11/1988

(Continued)

*Primary Examiner*—George A Bugg
*Assistant Examiner*—Hongmin Fan
(74) *Attorney, Agent, or Firm*—Sughrue Mion, PLLC

(57) ABSTRACT

The present invention relates to a system for determining particle transmittance $T_x$ of a filter for use with a particle detection system to provide a filter warning for aspirated particle detection systems by detecting a level of first particles having a size indicative of smoke particles and which pass through the detection system; determining an integrated smoke hours value by integrating the detected level of first particles over time; estimating the smoke particle transmittance $T_x$ of the filter by applying a predetermined weighting operation to the integrated smoke hours value. An empirical measure of a filter's particle transmittance $T_x$, due to at least first particles having a size indicative of smoke particles may be achieved by way of integrating a level of such first particles passing through a particle detection system over time to determine the proportion of smoke particles arrested by a filter, "integrated smoke hours". The "integrated smoke hours" value is, generally, a measure of cumulative filter blockage over time by smoke like particles and is a measure of a given amount of ambient smoke detected and recorded by a smoke detector system and integrated over the time of exposure of the smoke detector system to the ambient smoke. Using this method it is not necessary to infer the actual "filter load" per-se or, the actual particle mass trapped in the filter.

18 Claims, 5 Drawing Sheets

U.S. PATENT DOCUMENTS

| | | | | | |
|---|---|---|---|---|---|
| 4,524,351 | A | * | 6/1985 | Kimura et al. | 340/629 |
| 5,606,311 | A | | 2/1997 | Polidan et al. | |
| 5,821,865 | A | * | 10/1998 | Solak | 340/628 |
| 6,052,058 | A | * | 4/2000 | Knox | 340/607 |

FOREIGN PATENT DOCUMENTS

| | | |
|---|---|---|
| EP | 0 638 885 A1 | 2/1995 |
| EP | 1 326 221 A3 | 7/2003 |

* cited by examiner

METHOD AND SYSTEM FOR DETERMINING PARTICLE TRANSMITTANCE OF A FILTER IN PARTICLE DETECTION SYSTEM

RELATED APPLICATIONS

This application claims priority to Australian Provisional Patent Application No. 2003903703, filed 18 Jul. 2003 and entitled "Method and System for a Filter" and, the specification thereof is incorporated herein by reference in its entirety and for all purposes.

FIELD OF INVENTION

The present invention relates to a filter system for particle detectors. In particular, the present invention relates to a method and system for determining particle transmittance of a filter, for example, for use with a smoke detection system of the kind in which a detector produces an electrical output indicating the concentration, in the air, of particles produced by smoke or fire. In one form, the invention relates to a device and a method of providing a filter warning for aspirated smoke detection systems, and it will be convenient to hereinafter describe the invention in relation to that application. It should be appreciated, however, that the present invention is not limited to that application, only.

BACKGROUND OF INVENTION

Throughout this specification the use of the word "inventor" in singular form may be taken as reference to one (singular) or all (plural) inventors of the present invention.

Fire protection and suppressant systems may operate by detecting the presence of smoke and other airborne pollutants or, in general, particles. Upon a threshold level of smoke being detected, an alarm may be activated and operation of a fire suppressant system may be initiated. While the fire itself will cause damage, considerable property damage and also environmental damage may also be caused by operation of the fire suppression system and subsequent removal of the suppressant may be quite hazardous. A detection system, which is sufficiently sensitive to detect an abnormal condition prior to the onset of a fire, is very advantageous as it enables action to be taken at a very early stage before the onset of actual fire conditions. For example, when most substances are heated, even before heating occurs to a point at which a fire commences, emissions will be generated and if these can be detected by a suitably sensitive system, a warning provided at that very early stage may allow the problem to be detected and rectified, or equipment turned off for example, before the fire actually starts.

Aspirated smoke detection systems may incorporate a sampling pipe network consisting of one or more sampling pipes with sampling holes installed at positions where smoke or pre-fire emissions may be collected. Air is drawn in through the sampling holes and along the pipe by means of an aspirator or fan and is directed through a detector at a remote location. Although there are a number of different types of smoke detectors which may be used in a system as outlined above. Optical scatter detectors, have been found to provide suitable sensitivity at reasonable cost. Optical scatter detectors operate on the principle that smoke particles or other airborne pollutants when introduced into a detection chamber and subjected to a high intensity light beam will cause light to scatter. A light sensor senses the scattered light. The greater the amount of smoke particles within the sample introduced into the detector chamber the greater will be the amount of light scatter. The scatter detector detects the amount of scattered light and hence is able to provide an output signal indicative of the amount of smoke particles or other pollutant particles within the sample flow.

A difficulty arises in operation of aspirated smoke detector systems of the above kind in that most atmospheres where smoke or fire detection is required contain dust which may interfere with operation of the system. A filter may therefore be incorporated into the system for the purpose of keeping dust away from sensitive optical surfaces and to prevent dust from artificially affecting the detection of particles indicative of the presence of fire and/or smoke. For example with optical scatter type detectors, the presence of dust may seriously affect the detector output since dust particles may be generally larger than the particles which are indicative of the presence of smoke or fire and produce more scattered light than those particles.

Over time a filter used to reduce dust transmittance into the detection chamber will eventually fill with dust, which may prevent passage therethrough of not only dust particles, but also smoke particles. This causes the effective sensitivity of the detector system to drop. Attempts have been made in the prior art to alleviate this difficulty, for example, see granted U.S. Pat. No. 6,052,058 entitled Filter Integrity Monitoring System in the name of the present applicant, the contents of which are incorporated herein by reference.

When detecting smoke in a given environment, it is important to discriminate between smoke particles and dust particles, both of which will scatter light once in the detection chamber. Ideally dust particles are removed from the airflow path and smoke particles are allowed to continue through to the detection chamber. Thus, in an ideal situation, dust transmittance through the filter would be zero, and smoke transmittance would be 100%. Unfortunately no known filter has this characteristic transmittance. One problem is that there is some overlap in sizes between smoke and dust particles, and therefore the functionality of the filter is usually a compromise between arresting all dust and unintentionally arresting some larger smoke particles thereby decreasing the apparent smoke level seen by the detector, and allowing all smoke through with some dust, thereby increasing the apparent smoke level seen by the detector. Another problem with filters is that they may block over time. If a filter blocks, it may not transmit smoke particles to the detection chamber, thus reducing the effectiveness of the smoke detector. For this reason it is desirable to be able to detect filter blocking before it causes problems in smoke detection.

Any discussion of documents, devices, acts or knowledge in this specification is included to explain the context of the invention. It should not be taken as an admission that any of the material formed part of the prior art base or the common general knowledge in the relevant art on or before the priority date of the invention disclosed herein or, any claims defined herein.

SUMMARY OF INVENTION

In one aspect the present invention provides a method of determining particle transmittance of a filter in a particle detection system, the method comprising the steps of:

detecting a level of first particles having a size indicative of smoke particles and which pass through the detection system;

determining an integrated smoke hours value by integrating the detected level of first particles over time;

estimating the smoke particle transmittance of the filter by applying a predetermined weighting operation to the integrated smoke hours value.

In essence the present invention stems from the realisation that an empirical measure of a filter's smoke particle transmittance, due to at least first particles having a size indicative of smoke particles may be achieved by way of integrating a level of such first particles passing through a particle detection system over time to determine the proportion of smoke particles arrested by a filter. Using this method it is not necessary to determine the actual "filter load" per-se. The "filter load" is a measurement of the actual particle mass trapped in the filter.

In one embodiment the estimated smoke particle transmittance is compared to a first threshold value at which it is predetermined that the transmittance of smoke particles by the filter has reached a first level and indicating a first level filter warning when the estimated smoke particle transmittance is less than or equal to the first threshold value.

Preferably, the method further comprises the steps of:

comparing the estimated smoke particle transmittance to a second threshold value at which, it is predetermined that the transmittance of smoke particles by the filter has reached a second warning level;

indicating a second level filter warning when the estimated smoke particle transmittance is less than or equal to the second threshold value.

The method may further comprise the steps of:

detecting and/or recording a level of second particles, having a size indicative of dust particles, passing through the detection system;

providing a cumulative count over time of the number of detected or recorded second particles;

determining an estimated combined first and second particle transmittance by combining the cumulative count of detected or recorded second particles and the estimated smoke particle transmittance.

The method may still further comprise the steps of:

comparing the estimated combined particle transmittance to the first threshold value and;

indicating the first level filter warning when the estimated combined particle transmittance is less than or equal to the first threshold value.

The method may yet further comprise the steps of:

comparing the estimated combined particle transmittance to the second threshold value and;

indicating the second level filter warning when the estimated combined particle transmittance is less than or equal to the second threshold value.

The first and/or second particles may either be detected prior to entering the filter of the detection system or after exiting the filter.

In another aspect, the present invention provides apparatus adapted to determine particle transmittance of a filter of an aspirated particle detector system comprising:

a detector for detecting a level of first particles having a size indicative of smoke particles and which, pass through the detection system;

an integrator for integrating the recorded level of first particles over time, thereby providing an integrated smoke hours value; and, an estimator for estimating the smoke particle transmittance of the filter by applying a predetermined weighting operation to the integrated smoke hours value.

Preferably, the predetermined weighting operation is a multiplication operation performed by a multiplier which, may be further adapted for use with a look up table.

Furthermore, in another aspect the present invention provides apparatus adapted to determine particle transmittance for a filter of an aspirated particle detector system, said apparatus comprising:

processor means adapted to operate in accordance with a predetermined instruction set, said apparatus, in conjunction with said instruction set, being adapted to perform the method of determining particle transmittance as herein disclosed.

In a further embodiment the present invention provides apparatus for monitoring a filter in a particle detection system, the apparatus comprising:

apparatus for determining particle transmittance as disclosed;

a comparator for comparing the estimated smoke particle transmittance to a first threshold value at which, it is predetermined that the amount of smoke particles arrested by the filter has reached a first warning level;

an indicator for indicating a first level filter warning when the estimated smoke particle transmittance is less than or equal to the first threshold value.

In another embodiment, the apparatus for monitoring a filter in a particle detection system further comprises:

a comparator for comparing the estimated smoke particle transmittance to a second threshold value at which, it is predetermined that the amount of smoke arrested by the filter has reached a second warning level;

an indicator for indicating a second level filter warning when the estimated smoke particle transmittance is less than or equal to the second threshold value.

In yet another embodiment, the apparatus for monitoring a filter in a particle detection system further comprises:

a detector for detecting second particles, having a size indicative of dust particles, passing through the detection system;

a counter for providing a cumulative count over time of the number of recorded second particles;

an estimator for estimating a combined particle transmittance by combining the cumulative count of recorded second particles and the estimated smoke particle transmittance.

The apparatus for monitoring a filter may still further comprise:

a comparator for comparing the estimated combined particle transmittance to the first threshold value and;

an indicator for indicating the first level filter warning when the estimated combined particle transmittance is less than or equal to the first threshold value.

The apparatus for monitoring a filter may yet further comprise:

a comparator for comparing the estimated combined particle transmittance to the second threshold value and;

an indicator for indicating the second level filter warning when the estimated combined particle transmittance is less than or equal to the second threshold value.

The comparator for comparing the estimated smoke particle transmittance to the first threshold value and the comparator for comparing the estimated smoke particle transmittance to the second threshold value may be one and the same apparatus.

The comparator for comparing the estimated combined particle transmittance to the first threshold value and the comparator for comparing the estimated combined particle transmittance to the second threshold value may also be one and the same apparatus.

The indicator for indicating the first level filter warning and the indicator for indicating the second level filter warning in the case of either the estimated smoke particle transmittance or the estimated combined particle transmittance may be one and the same apparatus.

In another aspect the present invention provides apparatus for monitoring a filter of a particle detection system, the apparatus comprising:

processor means adapted to operate in accordance with a predetermined instruction set, said apparatus, in conjunction with said instruction set, being adapted to perform the method of monitoring a filter in a particle detector system as herein disclosed.

Preferably, the predetermined weighting operation may comprise multiplying the integrated smoke hours value by a given multiplier value, for example, a multiplier value obtained from a look up table. The predetermined weighting operation will depend, however, on the material properties of a given filter and will vary accordingly from filter to filter. Further, various filter designs and materials may be expected to demonstrate various relationships between the smoke level to which they are exposed and the rate of reduction in smoke particle transmittance that they suffer, including either linear or non-linear relationships. For example, an underlying function employed by the present invention may be of the form:

$$x=\int(a(bS^c+dS))dt \qquad \text{Eqn 1}$$

where x=measure of filter lifetime used (integrated smoke hours);

S=recorded smoke level (eg, percentage (%) obscuration/meter) measured at exit of filter at any instant in time;

t=time; and, a, b, c and d are coefficients established from empirical testing of a given filter within a predetermined configuration of a particle detection system.

Preferably, for each filter design envisaged, accelerated levels of smoke are used to obtain the empirical testing data.

The above integral function applies to measurements where the flow rate of air in a detector system is not taken into account. In a given aspirated particle detector system the flow rate of air passing through the detector system may be taken as a constant. In practice and of more general application, flow rates may vary within a given detector system or from system to system. With various environmental changes or changes to system configurations, such as sample pipe network changes, the flow rate may not necessarily be considered as a constant, at least in an interval of time corresponding to a determination of integrated smoke hours. The inventor has realised that in these circumstances, the flow rate is a significant factor in the determination of a filter's smoke particle transmittance. Accordingly, in another aspect, which takes into account a given constant flow rate, the present invention provides a method of determining particle transmittance of a filter in a particle detection system, the method comprising the steps of:

detecting a level of first particles having a size indicative of smoke particles and which particles are suspended in air passing through the detection system;

determining the flow rate of air passing through the detection system;

determining an integrated smoke hours value by integrating the detected level of first particles over time;

determining an estimated smoke particle transmittance of the filter in accordance with an operation comprising multiplying the integrated smoke hours value with the determined flow rate.

Further, in yet another aspect, which takes into account a varying flow rate, the present invention provides a method of determining particle transmittance of a filter in a particle detection system, the method comprising the steps of:

detecting a level of first particles having a size indicative of smoke particles and which particles are suspended in air passing through the detection system;

determining the flow rate of air passing through the detection system;

determining a smoke hours value corresponding to the detected level of first particles;

determining an estimated smoke particle transmittance of the filter in accordance with an operation comprising multiplying the smoke hours value with the determined flow rate and integrating the operation over time.

In one embodiment the following integral function applies to a measurement involving constant flow rate:

$$x=\int(a(bS^c+dS))dt\times eFR \qquad \text{Eqn 2}$$

where x=measure of filter lifetime used (integrated smoke hours for a constant flow rate);

FR=Flow Rate of air in detector system;

e is a coefficient established from empirical testing of a given configuration of a particle detection system;

All other variables and coefficients are as defined above for Eqn 1.

The following integral function applies to a measurement involving varying flow rates of air in the detector system:

$$x=\int(a(bS^c+dS)\times eFR)dt \qquad \text{Eqn 3}$$

where x=measure of filter lifetime used (integrated smoke hours for a variable flow rate);

FR=Flow Rate of air in detector system;

e is a coefficient established from empirical testing of a given configuration of a particle detection system;

All other variables and coefficients are as defined above for Eqn 1 and Eqn 2.

The "integrated smoke hours" value defined above is, generally, a measure of cumulative filter blockage over time by smoke like particles and that general measurement is referred to hereinafter as "integrated smoke hours". It is empirically a measure of a given amount of ambient smoke detected and recorded by a smoke detector system and integrated over the time of exposure of the smoke detector system to the ambient smoke. "Smoke like particles" refers to particles, being either smoke or otherwise, which have a particle size in the order of that of smoke particles, for example, smog and other ambient air pollutants. Owing to their size, these smoke like particles display similar properties to actual smoke particles. In particular, they scatter light in a similar fashion to smoke particles and as a result, their characteristic output from a light scatter detector is accordingly similar to a scatter detector's output produced by smoke particles.

Preferably, the period of time in which the above integrations may be performed ranges from the time at which the detector begins operation with a new or fresh filter until either:

(a) the estimated smoke transmittance is less than or equal to the first threshold value, at which time the first level filter warning may indicate that the filter requires replacing; or, (b) the estimated smoke transmittance is less than or equal to the second threshold value, at which time the second level filter warning may indicate a critical fault where filter end-of-life is signalled.

Particle transmittance as referred to herein is defined as the ratio of detectable particle level output by a filter to the detectable particle level input to the filter. In operation, it is possible to utilise the above method and a smoke detection system in accordance with the invention to produce or flag a filter warning or fault condition when the estimated transmittance reaches a threshold at which a predetermined reduction of the transmittance of the filter may be deemed to indicate an unacceptable degradation in filter performance. For example, the predetermined reduction in particle transmittance may be between about 2% and about 40%, and preferably about 10%. A further critical fault condition may be flagged at a point in time when the integrated smoke hours reaches a further threshold at which a further predetermined critical reduction of the particle transmittance of the filter may be predicted. For example, the further predetermined critical reduction in particle transmittance may be between about 10% and about 70%, and preferably about 15%.

In another embodiment a method of indicating particle transmittance includes:

Detecting the amount of smoke passing through a detection chamber

Summing the amount of detected smoke passing through the detection chamber over time to ascertain total integrated smoke hours;

Comparing the total amount of smoke passed through the detection chamber with a predetermined value;

Sending a signal indicating when the total integrated smoke hours has exceeded the predetermined value.

It has been found that smoke passing through a filter, as estimated by the smoke passing through the detection chamber, can be used to estimate the blocking of a filter. For a known filter type and design, it is possible to estimate particle transmittance of the filter by ascertaining the amount of smoke that has already passed through the filter.

In an embodiment of the present invention there is provided a computer program product comprising:

a computer usable medium having computer readable program code and computer readable system code embodied on said medium for determining particle transmittance of a filter in a particle detection system within a data processing system, said computer program product comprising:

computer readable code within said computer usable medium for performing the method of determining particle transmittance of a filter in a particle detection system as herein disclosed.

In another embodiment there is provided a computer program product comprising:

a computer usable medium having computer readable program code and computer readable system code embodied on said medium for monitoring a filter in a particle detection system within a data processing system, said computer program product comprising:

computer readable code within said computer usable medium for performing the method of monitoring a filter in a particle detection system as herein disclosed.

In yet another embodiment there is provided a computer program product comprising:

a computer usable medium having computer readable program code and computer readable system code embodied on said medium for indicating particle transmittance within a data processing system, said computer program product comprising:

computer readable code within said computer usable medium for performing the method of indicating particle transmittance as herein disclosed.

Other preferred forms, aspects and embodiments are disclosed in the specification and/or defined in the appended claims, forming a part of the description of the invention.

BRIEF DESCRIPTION OF THE DRAWINGS

Other features, disclosure, improvements, aspects and advantages of one or more preferred embodiments of the present invention will be readily apparent to one of ordinary skill in the art from the following written description with reference to and, used in conjunction with, the accompanying drawings which are given by way of illustration only, and thus are not limiting to the scope of the present invention, and in which.

DESCRIPTION OF PREFERRED EMBODIMENT

Figure 1:
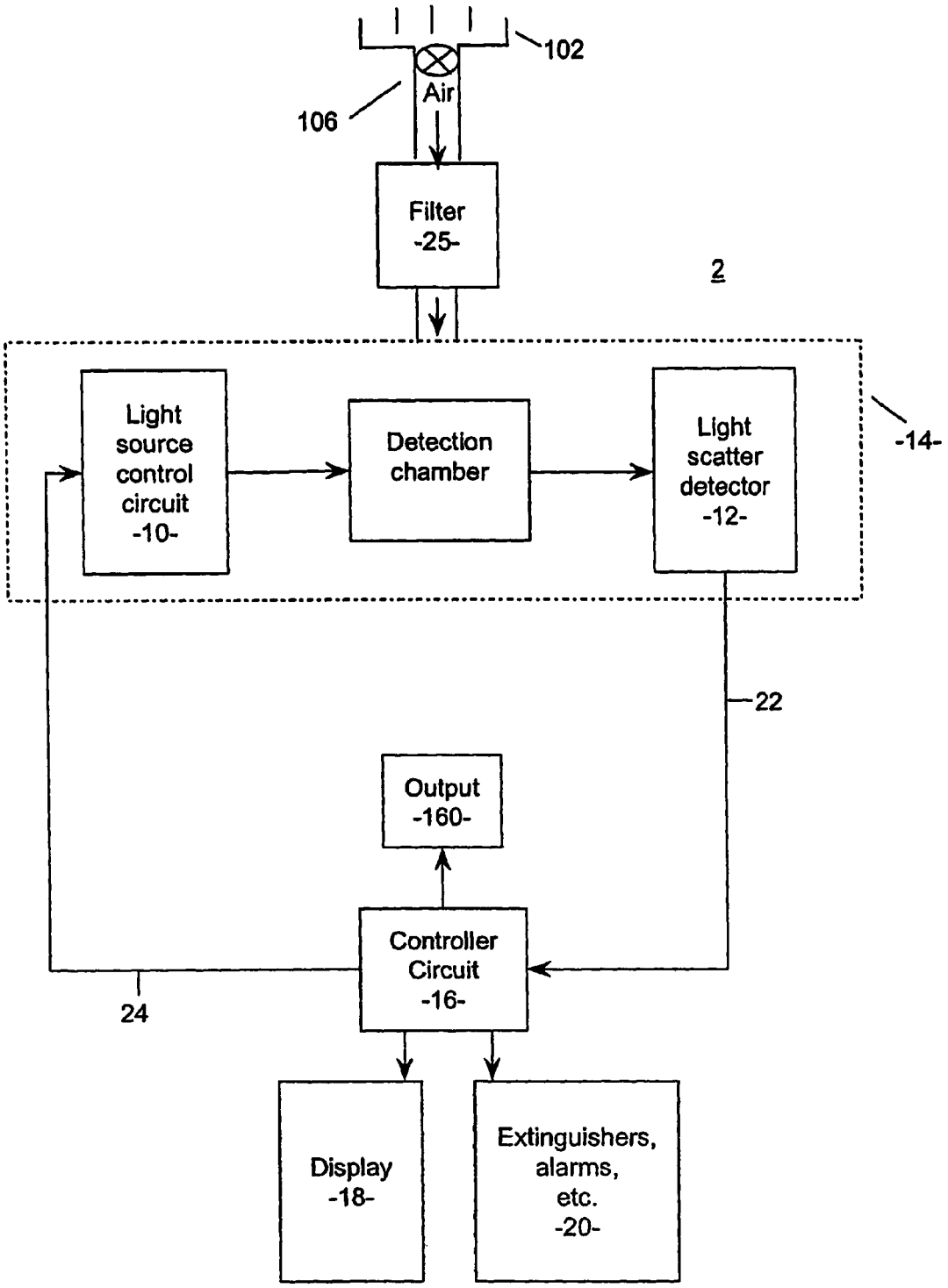
FIG. 1 is a block diagram of a particular particle detector system, namely an optical scatter detection system, such as in a smoke and fire detection system, in accordance with a preferred embodiment of the present invention.

Initially referring to FIG. 1, an example particle detector system being an aspirated smoke detector 2 is shown having a pipe network 102, a detection chamber 14, a light source 10, a detector 12, an aspirator 106 and a controller 16. Also shown is an output 160, display 18 and alarm and extinguishing equipment 20. A filter 25 is located before the detection chamber 14 to filter unwanted particles from the. From the chamber 14 the sampled air is expelled to the outside environment of the detection system.

Filter 25, such as a volume foam filter having pores, will accumulate particles within the pores over its life. The particles appear to block the pores, reducing particle transmittance, however the exact mechanisms of filter blocking are not known. Blocked pores will not let dust or all smoke particles through, but may still let air through at flow rates and with pressure drops that are very close to the initial conditions, thus making it impractical to detect a filter which is substantially blocked to smoke by monitoring airflow or pressure drop alone. Flow sensors are typically used in aspirated smoke detectors to recognise failures of the aspirator (fan) and to recognise gross failures of the sampling pipe network such as breakage or blockage of sampling holes. Flow sensors, however, cannot determine when a filter has become significantly blocked due to the transmission of smoke particles as air will continue to pass largely unhindered through the filter medium, even if a significant proportion of the particles within the air passing through the filter are not transmitted. In most applications of filters, this is not necessarily a disadvantage, as, for example with air filters for air-conditioning units, it is desirable to remove as many particles as possible. Any measurable reduction in airflow rate only occurs long after the filter has ceased to pass particles. Nonetheless, as noted above, in accordance with embodiments of the present invention, the inventor has realised that an empirical measurement of the particle transmittance of a filter may depend upon a measurement of integrated smoke hours as well as a measurement of flow rates comprising constant and variable flow rates. An increase in flow rate over time, for a given value of integrated smoke hours, contributes in a proportional manner to a reduction in particle transmittance of a given filter.

Typically the pores in a filter are many times larger than the dust to be blocked; however volume foam filters have a relatively long channel for a dust particle to travel through. Particles travelling through filters with pores are frequently trapped within the filter due to their inertia and attraction to the walls of the filter as they draw close thereby, rather than completely blocking a channel. The mechanisms behind particles being trapped in filters and filter blocking are generally not well understood, and therefore reliance is often made on empirical assumptions based on anecdotal evidence. In the present invention, a distinction is made between dust particles and smoke particles, mainly on their size. In general, the majority of smoke particles encountered can be said to range in size from <0.1 microns to approximately 5 microns. The majority of dust particles range in size from 5 microns upwards.

Referring to FIG. 1 in detail, an optical scatter detection system forms the detector for an aspirated smoke detection system 2 as shown in block diagram form. A light source controlling circuit 10 controls a light source such as a laser light source, which illuminates a scatter detection chamber 14. The scatter detection chamber 14 is provided with a source of air in which smoke particles are to be detected. This air is passed into the detector chamber 14 via a suitable filter 25. Light from the light source 10 is scattered by airborne particles introduced into the detection chamber 14, and a light scatter detector 12 detects the scattered light. An example of such an arrangement can be seen in a Vesda® LaserPlus™ Detector sold by the applicant.

A controller circuit 16 is coupled to the light source controlling circuit 10 and to the light scatter detector 12. Controller circuit 16 receives signals on line 22 from the light scatter detector 12, which signal is indicative of the amount of light reaching the light scatter detector 12 from the laser light source incorporated into the light source control circuit 10, after the light has been scattered by passing through the detection chamber 14. A control signal is output from controller 16 on line 24 to light source controlling circuit 10, to control the light source controlling circuit 10.

Figure 2:
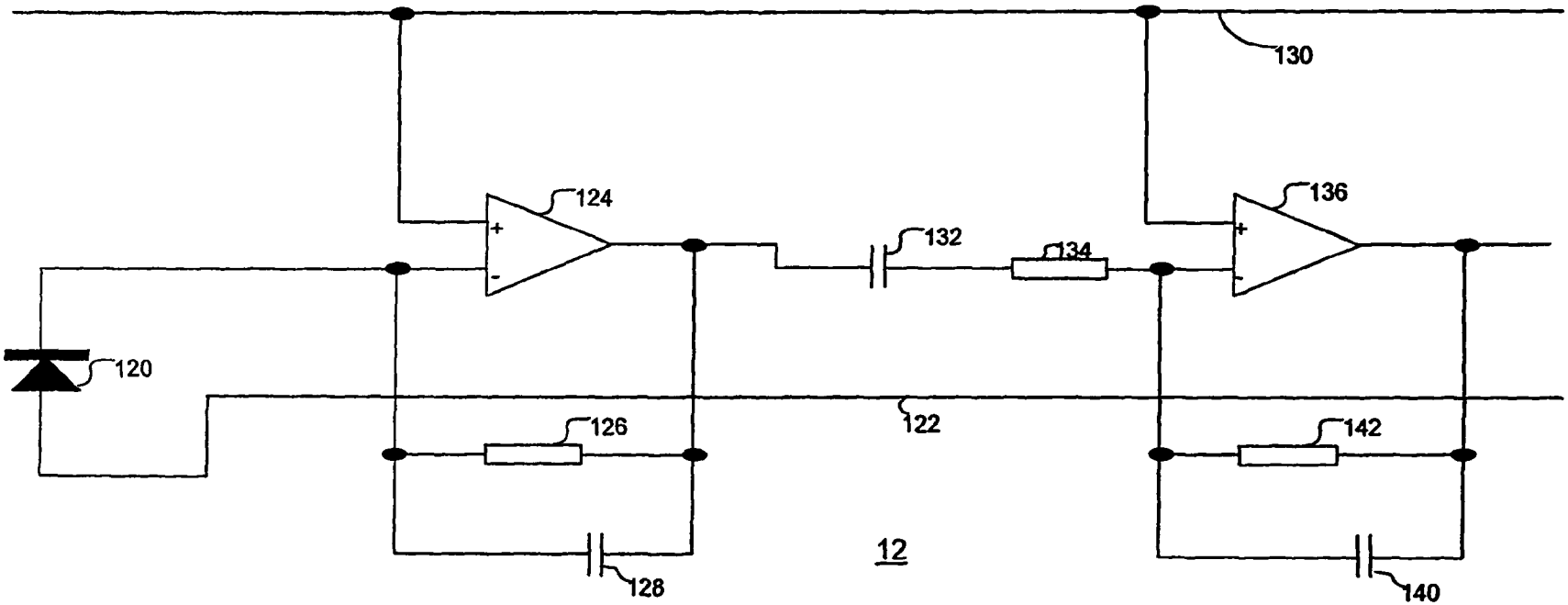
FIG. 2 is a schematic diagram of an optical scatter detector included in the system of FIG. 1 in accordance with a preferred embodiment of the present invention.

The controller circuit 16 may control alarm apparatus, such as a suitable display 18 to indicate the level of detected smoke, based on the light level detected by the detector 12. The components of the above system may generally be formed in conventional manner. Detector 12 may be formed as shown in FIG. 2. A photodiode 120 is shown arranged to receive light from the source 10 having passed through the detection chamber 14. Photodiode 120 is between a ground line 122 and the inverting input of an operational amplifier 124. The parallel resistor 126 and capacitor 128 shown connect the inverting input and the output of amplifier 124, and the non-inverting input is connected to voltage bias rail 130.

Output from amplifier 124 is taken via the series connected capacitor 132 and resistor 134 to the inverting input of a second amplifier 136. The non-inverting input of this is again connected to the rail 130, whilst the inverting input and output are connected via the parallel capacitor 140 and resistor 142 shown. The photodiode may for example be of type BPW34 and the operational amplifiers may be of type LMC662. The arrangement of this circuit is such that the first amplifier stage represented by amplifier 124 and associated components generates an output signal proportional to the current from the photodiode 120 and provides a first order low pass filter to remove high frequency noises. The second stage, provided by capacitor 132, resistor 134 and the amplifier 136 and associated components, provides a high pass filter which removes DC offsets and provides additional gain. Output from amplifier 136 is applied to the controller circuit 16.

Figure 3:
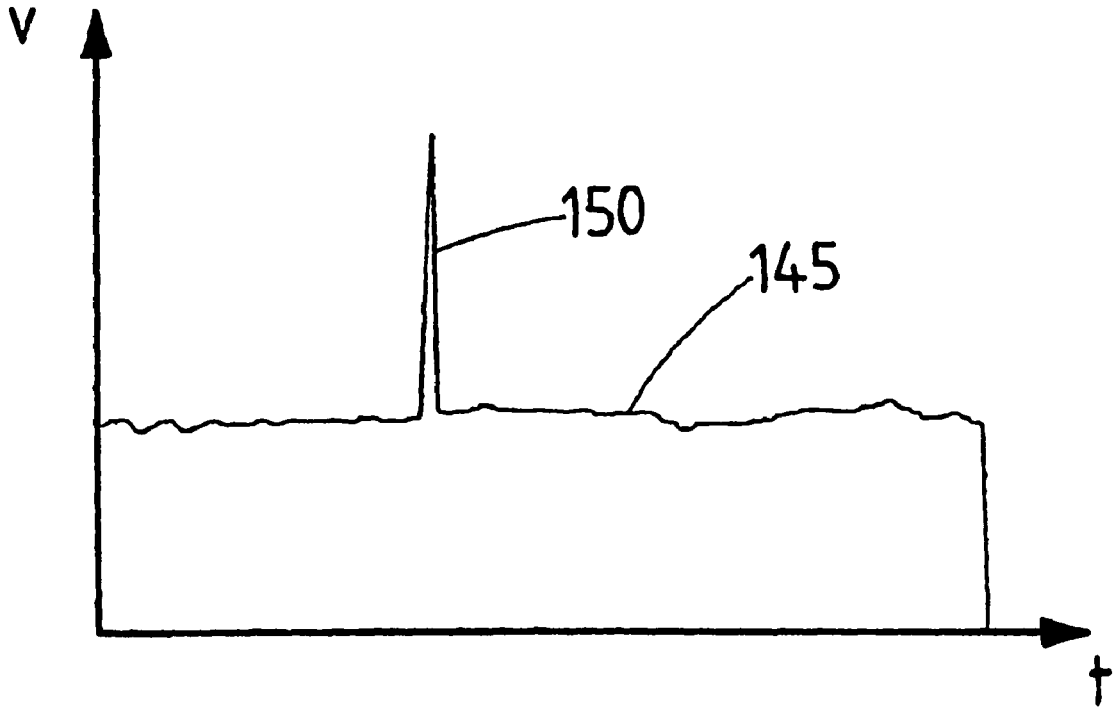
FIG. 3 is a diagram illustrating typical output from the detector of FIG. 2 for both detected smoke like and dust particles.

FIG. 3 shows a representative output signal 145 from the detector 12. In this case, signal 145 is an analog output. The signal level, overall, is representative of the an output from the detector 12. The output from the detector 12 is proportional to the amount of scattered light detected within the chamber, which is itself proportional to the concentration of particles in the air within chamber 14. Many of the particles within air in chamber 14 are smoke particles, but some may be dust particles. When dust particles pass through the filter 25, they produce a characteristic signature in the output as shown. In particular, a spike 150 is produced in the output signal. Generally, there will be one such spike for each detected dust particle. The reason why the dust particles cause spikes of this kind is that the dust particles are generally much bigger than the particles which are otherwise detected for purposes of smoke or fire detection The method and apparatus of the present invention infers the filter condition by using the relatively slowly changing smoke signal 145 generated by a large number of small particles, integrated over time, rather than simply counting the number of transient "spikes" produced from single large dust particles, only, as shown in FIG. 3 at 150. To calculate the level of smoke, the spikes are removed from the signal, to smooth the signal to be a better representation of the level of smoke in the chamber. The spikes are not discarded, but may also be counted to ascertain the number of dust particles flowing through the chamber 14.

Figure 5:
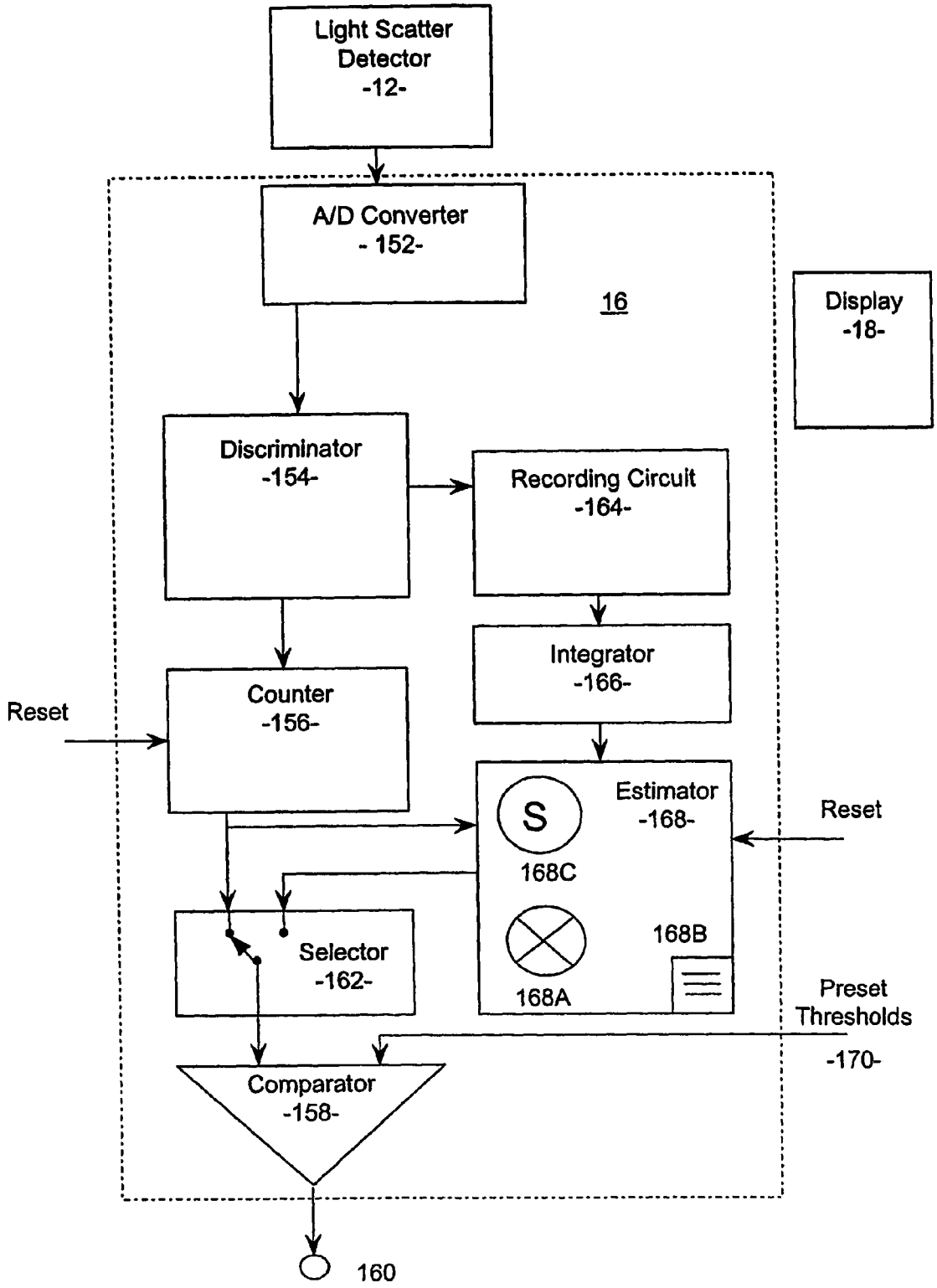
FIG. 5 is a block diagram of a control circuit incorporated into the system of FIG. 1 in accordance with a preferred embodiment of the present invention.

Referring to FIG. 5, in the controller 16, signals of the form shown in FIG. 3 may be signal conditioned and applied to an analog/digital converter 152 to provide a digital signal representative thereof, which digital signal may then be applied to, for example, a discriminator 154 for determining the spikes associated with the detection of dust particles as described in U.S. Pat. No. 6,025,058.

The controller 16 may also comprise circuitry 164 for recording the steady signal indicative of fire hazard smoke particles and other non-fire hazard smoke like particles. Further to this, integrating circuitry 166 may be incorporated into the controller to integrate the measured or recorded signal of the smoke like particles over time. An estimator 168 determines either the smoke particle transmittance alone as an output with the aid of a multiplier 168A adapted for use with a look up table 168B or, the cumulative count from counter 156 may be utilised by estimator 168 and combined, for example by summer 168C, with the estimated smoke particle transmittance to produce an output estimating the combined particle transmittance. In practice the values used for predetermining the weighting operation applied to the integrated smoke hours value stem from the physical properties of a given filter and the environmental conditions in which the filter is operating. These values may be stored in the look up table 168B. The output of estimator 168 or the output of dust counter 156 is applied, via selector 162, to comparator 158 which may compare the outputs of estimator 168 or the outputs of counter 156 to given preset thresholds 170. The preset thresholds may be preset counts in the case of a dust count alone and/or preset particle transmittances in the case of either the estimated smoke particle transmittance alone or a combined estimated particle transmittance. The output 160 of comparator 158 may be used to set warning indicators based on the result of comparisons with the given preset threshold values 170.

Figure 4:
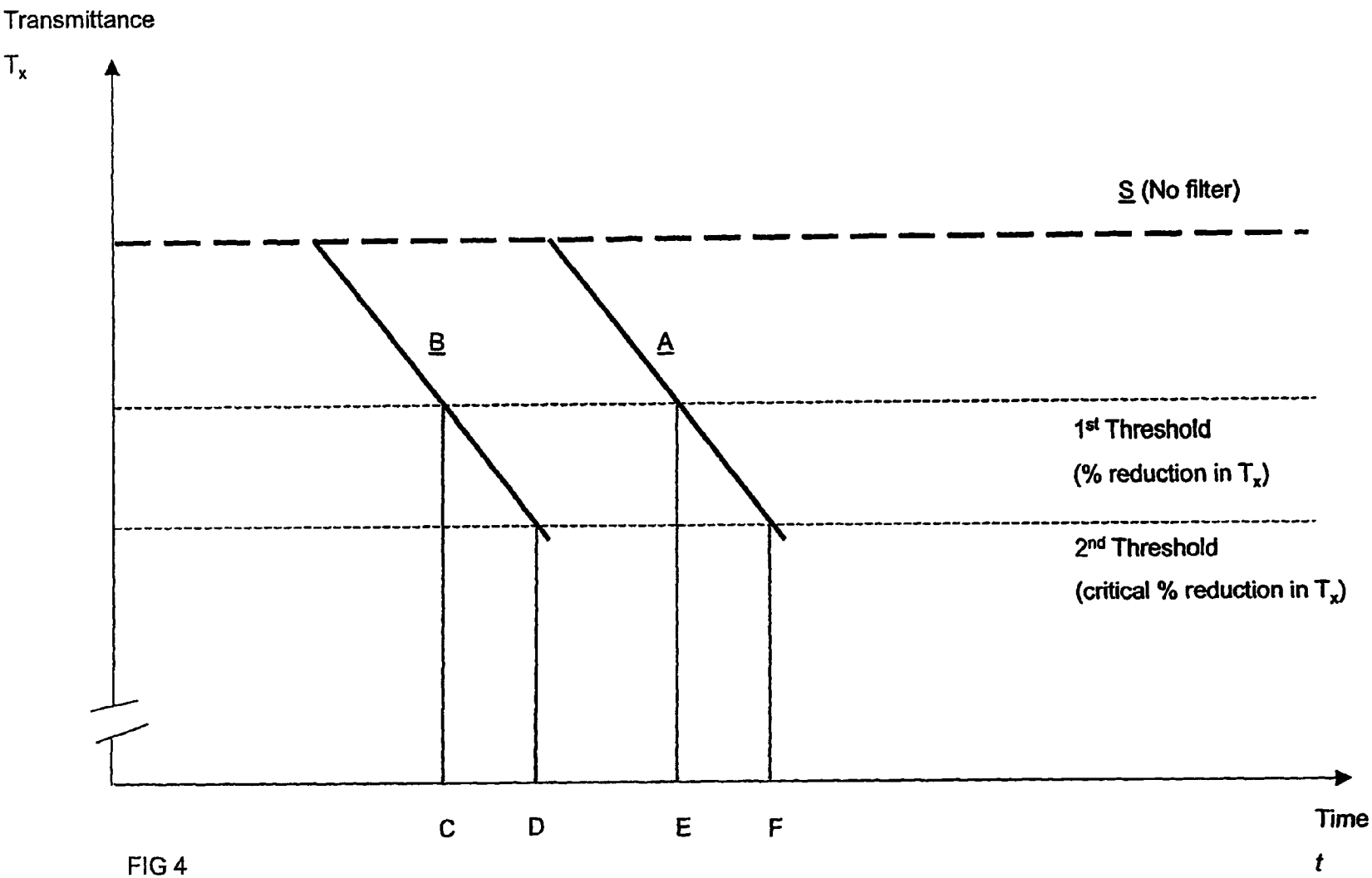
FIG. 4 is a graphical illustration of estimated filter particle transmittance curves produced in accordance with embodiments of the present invention.

FIG. 4 illustrates the relationship between particle transmittance $T_x$ and time t in graphical form for three cases. It would be understood by the person skilled in the art that for the purposes of this description the actual magnitude of the particle transmittance $T_x$ is arbitrary rather it is comparative values of transmittance $T_x$ that are noteworthy for this discussion. Thus, the vertical axis in FIG. 4 indicating transmittance $T_x$ is shown as a discontinuous axis. Dashed line S represents particle transmittance $T_x$ in a smoke detector system with no filter trapping smoke or dust particles. Also shown are two curves, A and B, representing estimated filter particle transmittances determined in accordance with the present invention. Curve A represents the estimated smoke particle transmittance $T_x$ relationship in situations where estimates are made based on smoke particle levels summed over time (which may be referred to as smoke hours). The higher the smoke hours, the more smoke particles trapped in the filter which relates to a reduction in smoke particle transmittance. Curve B represents the estimated combined smoke particle transmittance $T_x$ relationship when integration of smoke particles over time is taken into account with dust particle transmission. The difference between the positions of the two curves will be related to the amount of smoke in the air in relation to dust. Previously this relationship was not considered important. For the case of curve A, the estimated smoke like particle transmittance $T_x$ is a generally linear relationship. Curve B is a generally linear relationship of the combined particle transmittance $T_x$ of a filter where, in accordance with a preferred embodiment of the present invention, the estimated smoke particle transmittance $T_x$ is combined with the cumulative count of dust particle events to provide the combined estimated filter particle transmittance $T_x$ due to both dust and smoke like particles. As noted, straight dashed line S represents the case where all particles both dust and smoke like are transmitted through the detector system in the absence of any filter. Curve A is a linear fall off curve representing an estimate in accordance with one embodiment of the invention of the smoke particle transmittance $T_x$ which is based solely on the integrated smoke hours value. At point E on the time axis, the estimated smoke particle transmittance $T_x$ has fallen to the first threshold value at about 10% reduction in transmittance $T_x$. At this point in time a filter warning may be issued indicating that the filter should be replaced. At point F on the time axis the smoke particle transmittance $T_x$ has fallen to the second threshold value at about 15% reduction in the transmittance $T_x$ where a critical fault may be indicated by a second level warning. In a preferred form of the invention a combined filter particle transmittance $T_x$ is estimated which results in curve B. Given that the curve now represents the reduction in particle transmittance $T_x$ due to both smoke like and dust particles, the drop off from straight line S occurs earlier in time. It has been found that the initial reduction in transmission of smoke for both curves A and B occurs almost as soon as the filters are used, and accordingly for the purposes of illustration, the representations of linear curves A and B of FIG. 4 have in effect exaggerated the time it takes for the drop off to commence in both cases. As in the case of curve A, curve B falls to a point at C on the time axis where the first threshold value is reached and about 10% reduction in particle transmittance $T_x$ occurs prompting a first warning level for replacing the filter. Likewise, at point D on the time axis, curve B reaches the second threshold value where about 15% reduction in particle transmittance $T_x$ is estimated to occur prompting a critical second warning indicating an end of life for the filter.

It is possible to correlate a given particle transmittance based on a cumulative dust particle count to an equivalent estimate of a reduction in smoke particle transmittance based on the weighted integrated smoke hours. For example, see table 1 showing some empirical results:

TABLE 1

| # (Dust particle count, cumulative) | % Reduction in smoke particle transmittance (integrated smoke hours, weighted) |
|---|---|
| $4 \times 10^6$ | 10 |
| $1 \times 10^7$ | 25 |

In a particularly advantageous embodiment and referring again to FIG. 1, the controller circuit 16 in combination with the light source control circuit 10 and detector 12 may be provided with feedback of the determined particle transmittance value in order to adjust the sensitivity of the light scatter detector. For example, if the particle transmittance is determined such that there is a degradation of 10% in the filter's transmittance a corresponding adjustment of detector gain may be activated to compensate for the filter degradation. Equally, the detector sensitivity may be adjusted in accordance with the cumulated count of dust particles or, more preferably, the combined particle transmittance $T_x$ as provided by the cumulated count of dust particles and the integrated smoke hours.

As the present invention may be embodied in several forms without departing from the spirit of the essential characteristics of the invention, it should be understood that the above described embodiments are not to limit the present invention unless otherwise specified, but rather should be construed broadly within the spirit and scope of the present invention as defined in the appended claims. Various modifications and equivalent arrangements are intended to be included within the spirit and scope of the present invention and appended claims. For example, with respect to the embodiment of a detection system as shown in FIG. 1, the system may be further modified so that the air delivered to chamber 14 is derived directly from the incoming air to filter 25 rather than the outlet air from the filter. In this case, a higher maximum filter load will be required because there will be more particles either dust or smoke like present. Therefore, the specific embodiments are to be understood to be illustrative of the many ways in which the principles of the present invention may be practiced. In the following claims, means-plus-function clauses are intended to cover structures as performing the defined function and not only structural equivalents, but also equivalent structures. For example, although a nail and a screw may not be structural equivalents in that a nail employs a cylindrical surface to secure wooden parts together, whereas a screw employs a helical surface to secure wooden parts together, in the environment of fastening wooden parts, a nail and a screw are equivalent structures.

The present invention provides a method and apparatus for allowing continually monitoring of the condition of a filter and alleviates the need for excessively frequent testing and maintenance of a smoke or fire detection system. Accordingly, the risk of failure of the detection system to operate in the event of fire is reduced.

"Comprises/comprising" when used in this specification is taken to specify the presence of stated features, integers, steps or components but does not preclude the presence or addition of one or more other features, integers, steps, components or groups thereof."

The invention claimed is:

1. A method of determining particle transmittance of a filter in a particle detection system, the method comprising the steps of:

detecting a level of first particles having a size indicative of smoke particles and which pass through the detection system;

determining an integrated smoke hours value by integrating the detected level of first particles over time;

estimating the smoke particle transmittance of the filter by applying a predetermined weighting operation to the integrated smoke hours value.

2. The method of claim 1 wherein, the predetermined weighting operation comprises the step of multiplying the integrated smoke hours value by a predetermined multiplier value.

3. A method of determining particle transmittance of a filter in a particle detection system, the method comprising the steps of:

detecting a level of first particles having a size indicative of smoke particles and which particles are suspended in air passing through the detection system;

determining the flow rate of air passing through the detection system;

determining an integrated smoke hours value by integrating the detected level of first particles over time;

determining an estimated smoke particle transmittance of the filter in accordance with an operation comprising multiplying the integrated smoke hours value with the determined flow rate.

4. The method of claim 1, wherein, the step of determining an integrated smoke hours value comprises the following integration formula:

$$x=\int(a(bS^c+dS))dt$$

where x=measure of filter lifetime used (integrated smoke hours);

S=recorded smoke level (percentage (%) obscuration/meter)measured at exit of filter at any instant in time;

t=time; and, a, b, c and d are coefficients established from empirical testing of a given filter within a predetermined configuration of a particle detection system.

5. The method of claim 3 wherein, the step of determining an integrated smoke hours value comprises the following integration formula:

$$x=\int(a(bS^c+dS))dtxeFR$$

where x=measure of filter lifetime used;

FR=Flow Rate of air in detector system being a constant value;

e is a coefficient established from empirical testing of a given configuration of a particle detection system;

S=recorded smoke level (percentage (%) obscuration/meter) measured at exit of filter at any instant in time; t=time; and, a, b, c and d are coefficients established from empirical testing of a given filter within a predetermined configuration of a particle detection system.

6. A method of determining particle transmittance of a filter in a particle detection system, the method comprising the steps of detecting a level of first particles having a size indicative of smoke particles and which particles are suspended in air passing through the detection system;

determining the flow rate of air passing through the detection system;

determining a smoke hours value corresponding to the detected level of first particles;

determining an estimated smoke particle transmittance of the filter in accordance with an operation comprising multiplying the smoke hours value with the determined flow rate and integrating the operation over time.

7. The method of claim 6 wherein, the step of determining an estimated smoke particle transmittance comprises the following integration formula:

$$x=\int(a(bS^c+dS)xeFR)dt$$

where x=measure of filter lifetime used;

FR=Flow Rate of air in detector system being a variable value;

e is a coefficient established from empirical testing of a given configuration of a particle detection system;

S=recorded smoke level (percentage (%) obscuration/meter) measured at exit of filter at any instant in time; t=time; and, a, b, c and d are coefficients established from empirical testing of a given filter within a predetermined configuration of a particle detection system.

8. A method of monitoring a filter in a particle detection system, the method comprising the steps of:

performing the method of claim 1;

detecting a level of second particles, having a size indicative of dust particles, passing through the detection system;

providing a cumulative count over time of the number of detected second particles;

determining an estimated combined first and second particle transmittance by combining the cumulative count of detected second particles and the estimated smoke particle transmittance comparing the estimated combined particle transmittance to a first threshold value at which, it is predetermined that the amount of smoke particles arrested by the filter has reached a first warning level;

indicating a first level filter warning when the estimated combined particle transmittance is less than or equal to the first threshold value;

comparing the estimated combined particle transmittance to a second threshold value at which, it is predetermined that the amount of smoke arrested by the filter has reached a second warning level and;

indicating a second level filter warning when the estimated combined particle transmittance is less than or equal to the second threshold value.

9. The method of claim 8 wherein the first threshold level corresponds to a reduction in particle transmittance between about 2% and about 40%.

10. The method of claim 8 wherein the second threshold level corresponds to a reduction in particle transmittance between about 10% and about 70%.

11. The method of claim 8 wherein, the period of time in which the integration is performed ranges from the time at which the detector begins operation with a new filter until either:

(c) the estimated combined particle transmittance is less than or equal to the first threshold value, at which time the first level filter warning indicates that the filter requires replacing; or, (d) the estimated combined particle transmittance is less than or equal to the second threshold value, at which time the second level filter warning indicates a critical fault where filter end-of-life is signalled.

12. The method of claim 1 wherein, the particles are detected prior to entering the filter of the detection system.

13. The method of claim 1, wherein, the particles are detected after exiting the filter of the detection system.

14. The method of claim 8, further comprising the step of:

adjusting the sensitivity of a detector of the particle detection system in accordance with at least one of:

a) the estimated smoke particle transmittance;

b) the cumulative count of detected second particles;

c) the estimated combined particle transmittance.

15. Apparatus adapted to determine particle transmittance for a filter of an aspirated particle detector system, said apparatus comprising:

processor means adapted to operate in accordance with a predetermined instruction set, said apparatus, in conjunction with said instruction set, being adapted to perform a method comprising the steps of:

detecting a level of first particles having a size indicative of smoke particles and which pass through the detection system; and determining an integrated smoke hours value by integrating the detected level of first particles over time;

estimating the smoke particle transmittance of the filter by applying a predetermined weighting operation to the integrated smoke hours value.

16. Apparatus for monitoring a filter of a particle detection system, the apparatus comprising:

processor means adapted to operate in accordance with a predetermined instruction set, said apparatus, in conjunction with said instruction set, being adapted to perform a method comprising the steps of:

detecting a level of first particles having a size indicative of smoke particles and which pass through the detection system;

determining an integrated smoke hours value by integrating the detected level of first particles over time;

estimating the smoke particle transmittance of the filter by applying a predetermined weighting operation to the integrated smoke hours value;

detecting a level of second particles, having a size indicative of dust particles, passing through the detection system;

providing a cumulative count of detected second particles and the estimated smoke particle transmittance comparing the estimated combined particle transmittance to a first threshold value at which, it is predetermined that the amount of smoke particles arrested by the filter has reached a first warning level;

indicating a first level filter warning when the estimated combined particle transmittance to a second threshold value at which, it is predetermined that the amount of smoke arrested by the filter has reached a second warning level; and indicating a second level filter warning when the estimated combined particle transmittance is less than or equal to the second threshold value.

17. A computer program product comprising:

a computer usable medium having computer readable program code and computer readable system code embodied on said medium for determining particle transmittance of a filter in a particle detection system within a data processing system, said computer program product comprising:

computer readable code within said computer usable medium for performing a method comprising the steps of:

detecting a level of first particles having a size indicative of smoke particles and which pass through the detection system;

determining an integrated smoke hours value by integrating the detected level of first particles over time;

estimating the smoke particle transmittance of the filter by applying a predetermining weighting operation to the integrated smoke hours value.

18. A computer program product comprising:

a computer usable medium having computer readable program code and computer readable system code embodied on said medium for monitoring a filter in a particle detection system within a data processing system, said computer program product comprising:

computer readable code within said computer usable medium for performing a method comprising the steps of:

detecting a level of first particles having a size indicative of smoke particles and which pass through the detection system;

determining an integrated smoke hours value by integrating the detected level of first particles over time;

estimating the smoke particle transmittance of the filter by applying a predetermined weighting operation to the integrated smoke hours value;

detecting a level of second particles, having a size indicative of dust particles, passing through the detection system;

providing a cumulative count over time of the number of detected second particles;

determining an estimated combined first and second particle transmittance by combining the cumulative count of detected second particles and the estimated smoke particle transmittance comparing the estimated combined particle transmittance to a first threshold value at which, it is predetermined that the amount of smoke particles arrested by the filter has reached a first warning level;

indicating a first level filter warning when the estimate combined particle transmittance is less than or equal to the first threshold value;

comparing the estimated combined particle transmittance to a second threshold value at which, it is predetermined that the amount of smoke arrested by the filter has reached a second warning level; and indicating a second level filter warning when the estimated combined particle transmittance is less than or equal to the second threshold value.

* * * * *